United States Patent [19]

Nojima et al.

[11] Patent Number: 4,515,833

[45] Date of Patent: May 7, 1985

[54] METHOD OF PRODUCING CAST COATED PAPER AND PRODUCT THEREOF

[75] Inventors: Kazuhiro Nojima; Hiroyuki Fujimoto; Mikio Takahashi, all of Amagasaki, Japan

[73] Assignee: Kanzaki Paper Mfg. Co., Ltd., Tokyo, Japan

[21] Appl. No.: 609,336

[22] Filed: May 11, 1984

[30] Foreign Application Priority Data

May 18, 1983 [JP] Japan ..... 58-88212

[51] Int. Cl.[3] ..... B05D 3/12

[52] U.S. Cl. ..... 427/362; 106/214; 428/510; 428/513; 428/478.8

[58] Field of Search ..... 427/362; 106/214; 428/510, 513, 478.8

[56] References Cited

U.S. PATENT DOCUMENTS

| | | | |
|---|---|---|---|
| 4,048,380 | 9/1977 | Blakey et al. | 427/362 |
| 4,124,688 | 11/1978 | Shibazaki et al. | 423/332 |
| 4,301,210 | 11/1981 | Yasuda et al. | 427/362 |
| 4,317,849 | 3/1982 | Ogura et al. | 427/362 |

FOREIGN PATENT DOCUMENTS

| | | | |
|---|---|---|---|
| 697132 | 11/1964 | Canada | 427/362 |
| 68187 | 6/1978 | Japan | 106/214 |

*Primary Examiner*—Theodore Morris

[57] ABSTRACT

An improved aqueous coating composition for the production of cast coated paper is disclosed. The pigment component of the coating contains at least 5% by weight of cubic calcium carbonate having a mean particle size of 0.1 to 1.0 micron. When this coating composition is used the operating speed of the cast coating process is remarkably improved and a cast coated paper having excellent whiteness, gloss and printability is obtained.

8 Claims, 2 Drawing Figures

METHOD OF PRODUCING CAST COATED PAPER AND PRODUCT THEREOF

BACKGROUND OF THE INVENTION

The present invention relates to aqueous coating compositions for the manufacture of cast coated paper and, more particularly, to coating compositions for cast coated paper having a high gloss, and to a method of producing cast coated papers at improved operating speeds, as well as to cast coated papers produced with said coating compositions.

Conventional methods of producing high gloss coated papers for printing, known as cast coated papers, include (1) the wet casting method adapted to produce a glossy coated paper by pressing the paper carrying a layer of wet coating against the surface of a heated drum having a highly polished finishing surface, (2) a gel-casting method adapted to produce a high gloss coated paper by pressing the paper carrying a layer of coating in the gel state against a heated polished drum, and (3) a rewet casting method which which employs a paper that has been coated and dried, following which the surface of the coated layer is then plasticized with a re-wetting agent and is pressed against the surface of a heated polished drum.

In each of these conventional casting methods, the surface of a coated layer in a plasticized state is pressed against a heated finishing surface (e.g., a heated, polished chromium plated drum) and dried in contact therewith and then released from the drum as a replica of the polished surface. Since the surface of the coated layer is dried in contact with the heated finishing surface in so producing cast coated papers, the moisture in the coated layer or the moisture of the re-wetting liquid must all pass through the paper layer to the opposide side and be evaporated. Because of the manner in which cast coated paper is thus dried, the speed of operation is extremely low at present, as compared to the rate of production of art papers and other similar coated papers, from which the moisture is evaporated directly from the surfaces of the coated paper. In addition, in the production of conventional cast coated papers a primary concern is to obtain a high gloss surface. Accordingly, a plate-like, crystalline kaolin which readily develops a high gloss has been the primary pigment used in formulating the coating compositions. Kaolin is oriented laterally not only on the surface of the coated layer but also within the coated layer in the same manner. Consequently, the conventional cast coated paper, while having a high gloss, exhibits relatively low moisture permeability. Thus, an important technological objective in the cast coated paper field has been to improve productivity by increasing the manufacturing speed.

In order to enhance the speed of manufacture of cast coated paper, consideration has been given to the pigment content of the coating. For example, it is known that pigments such as aluminum hydroxide, titanium dioxide, barium sulfate, precipitated calcium carbonate, natural ground calcium carbonate, calcium sulfite or zinc oxide, which have good moisture permeability as compared to kaolin, can be used instead of the kaolin or together with the kaolin.

If such pigments are used the moisture permeability is effectively improved as compared to the case in which only kaolin is used, but the gloss of the cast coated paper will be decreased and the ink gloss of the printed paper also will be reduced.

When calcium carbonate, for example, is used as a pigment for the cast coated paper, it is considered that a decrease in the gloss is caused by the anisotropic shape of particles of precipitated or natural ground calcium carbonate, such as oblong, spindly, spherical or amorphous shape but not cubic shape.

BRIEF SUMMARY OF THE INVENTION

It is an object of the invention to provide novel coating compositions for cast coated paper which produce a high gloss equivalent to the gloss obtained with coating compositions high in kaolin content and at the same time permit the cast coated paper to be produced at an increased operating speed. The cast coated paper coated with the novel coating composition of the invention has excellent printability.

More particularly, as a result of research carried out on pigments for the cast coated paper, with a view to solving the above-mentioned objective, the inventors have discovered that calcium carbonate having cubic crystals is unique as a cast coating pigment. A trial, using cubic calcium carbonate in coating compositions for coated paper such as art paper or similar coated papers, was disclosed in Japanese Patent Publication No. 50075/1980 and Japanese Patent Laid-open Publication No. 6817/1981, but these publications did not disclose the use of the cubic calcium carbonate as a pigment for the cast coated paper.

It has been discovered by the inventors of the present invention that if the pigment portion of the coating composition contains at least 5 percent by weight of cubic calcium carbonate having a mean particle size of 0.1 to 1.0 micron, said pigment will be reoriented on the surface of the cast coated layer so as to improve the gloss. On the other hand, since the pigment has properties to not orient within the cast coated layer, moisture permeability is remarkably improved.

The cubic calcium carbonate used in the invention includes, for example, calcium carbonate described in U.S. Pat. No. 4,124,688.

Other and further objects, features and advantages of the invention will appear more fully from the following description.

DETAILED DESCRIPTION OF THE PREFERRED EMBODIMENTS

Figure 1:
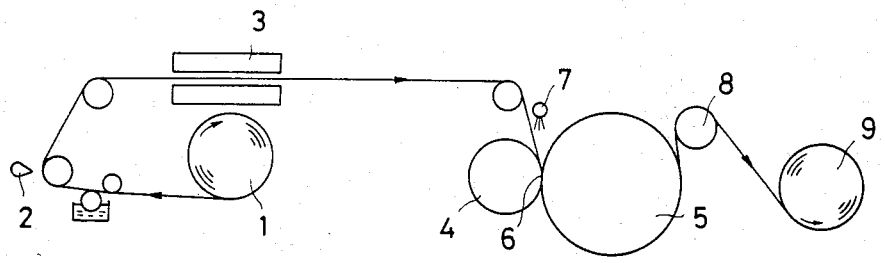
FIG. 1 is a schematic view of a rewet casting process used to carry out examples 1 to 11 according to the invention.

As described above, the cubic calcium carbonate used in coating compositions for cast coated paper of this invention does not relatively decrease the gloss of the cast coated paper as compared with anisotropic precipitated calcium carbonate, natural ground calcium carbonate or other amorphous pigment. Further, the cubic calcium carbonate has features such that the moisture permeability is as good as the anisotropic calcium carbonate and consequently the production speed of the cast coated paper can be improved. Such results can be obtained when the mean particle size of the cubic calcium carbonate is in a range of 0.1 to 1.0 micron, preferably in a range of 0.15 to 0.8 micron. If the mean particle size is smaller than 0.1 micron, permeability by air can be improved, but the bonding strength of the coating is decreased, with the result that it is necessary to increase the adhesive content of the coating, which is undesirable. If the mean particle size is larger than 1 micron, a decrease in the gloss is observed.

When the cubic calcium carbonate is used as a pigment for the cast coated paper, the reasons why a decrease in the gloss is relatively small and the operating speed is improved are not necessarily evident.

The above described pigment used for the cast coated paper of this invention exhibits less production of rough particles caused by secondary agglomeration. Because pigment particles are cubic, when the coated layer makes contact with the surface of a heated finishing surface, one plane of the cube is re-oriented to the finishing surface of the drum so as to obtain a smooth surface, while the cubic pigment in the interior of the coated layer is not oriented in the distribution, in the same manner as the conventional amorphous pigment is not oriented, so as to improve moisture permeability; these are considered to be the factors permitting increased operating speed. In addition, the pigment has excellent whiteness peculiar to the calcium carbonate, and good ink gloss is readily obtained despite rapid absorption of the ink, so that the cast coated paper has good printing properties.

A rewet casting method or a gel-casting method can be used as a casting method to illustrate the remarkable advantages of the invention. More specifically, since in the rewet casting method the coating layer is dried and solidified before being pressed against the heated finishing surface and since in the gel-casting method the coating layer is gelled and solidified before being pressed against the heated finishing surface, the coating layer is not caused to boil or otherwise form defects even when the coating layer contacts the heated drum at a temperature of above 90° C. Therefore, a higher operating speed is ensured. However, there is a disadvantage in these methods in that the coating layer when brought into contact with the surface of the drum is not highly plasticized. Thus, kaolin, which is easily reoriented on the surface of the drum, or cubic calcium carbonate of the invention, are particularly effective in providing high gloss, where the coating is in contact with the finishing surface while in a plasticized state for only a short time.

In the present invention, cubic calcium carbonate which exhibits such properties, is prepared by a method disclosed in the above-described U.S. Pat. No. 4,124,688 or Japanese Patent Laid-open Publication No. 43097/1978.

The proportion of such cubic calcium carbonate may be in a range of 5 to 100% by weight of the total pigment. If it is less than 5% by weight, the production speed is not improved. In the rewet casting method or the gel-casting method in which the coated layer contacts a heated finishing surface at a temperature of above 90° C., particularly 100° to 140° C., the proportion of the cubic calcium carbonate should be relatively high, preferably in a range of 30% to 80% by weight, and particularly, in a range of 40% to 70% by weight of the total pigment.

The cubic calcium carbonate is used alone or is used together with other pigment to formulate the coating compositions for the cast coated paper. Where another pigment is used with the cubic calcium carbonate, kaolin is most preferable so as to improve the gloss, but one or more of the pigments including aluminum hydroxide, satin white, barium sulfate, natural ground calcium carbonate, anisotropic precipitated calcium carbonate, talc, plastic pigment, calcined clay and titanium dioxide can be suitably selected so as to improve opacity, whiteness, production speed, printability or cost, when importance is not attached to gloss.

According to the invention as described above, coating compositions for cast coated paper containing at least 5 parts by weight of cubic calcium carbonate are provided. In order to prepare the coating compositions, an adhesive or adhesives, and in some instances an auxiliary agent, are incorporated in addition to the pigment. Suitable adhesives include one or more of the conventional adhesives for coated paper as follows: synthetic resin adhesives including conjugated diene polymer latexes such as styrene-butadiene copolymer and methylmethacrylate-butadiene copolymer, acrylic polymer latexes such as polymers or copolymers of acrylic acid ester and/or methacrylic acid ester; polyvinyl acetate latexes, such as ethylene-vinyl acetate copolymer; alkaline soluble or alkaline swellable polymer latexes modified by monomers which contain functional groups such as the carboxylic group in these polymers; polyvinyl alcohol, olefin-maleic anhydride resin, and melamine resin; and natural adhesives including casein, soybean protein, starch, oxidized starch, esterified starch, etherified starch, cationic starch and cellulose derivatives such as carboxymethylcellulose and hydroxyethyl cellulose. The quantity of the adhesive to be used is 5 to 50 parts, generally 10 to 30 parts, by weight for 100 parts by weight of the pigment.

The auxiliary agent may include, for example, a dispersant, anti-foaming agent, dye, release agent and fluidity modifier.

The coating composition for the cast coated paper composed of the above-described materials, is in general, prepared to a solids content in the range of 45% to 65% by weight, and the composition is applied to a base paper having a basis weight of approximately 80 to 400 g./m$^2$ so as to provide a dry coating weight of 10 to 50 g./m$^2$, and the coated paper is then cast finished.

The base paper may include groundwood free paper, neutralized base paper, or other suitable coating raw stock and the coating composition is coated directly on the paper or on pre-coated paper.

The coating is applied to the paper by any of the known devices such as a blade coater, an air knife coater, a roll coater, brush coater, a Champflex coater, a bar coater or a gravure coater. After the coating, the paper is finished by any of the wet casting methods, rewet casting methods or gel-casting methods.

Examples of the invention are as follows: the invention is not limited to these examples. The parts and percents (%) given in the examples are parts by weight and percent (%) by weight:

EXAMPLES 1 TO 10, COMPARISON EXAMPLES 1 TO 9

Mixtures of kaolin (Ultra White-90 from Engelhard Minerals and Chemicals Corporation, U.S.A.) and calcium carbonate of different mean particle sizes, in the proportions given in Table 1, were used. 100 parts of a given pigment mixture and 0.5 part of sodium polyacrylate were dispersed in water by means of a Cowles dissolver so as to prepare a pigment slurry having a solids content of 60%. To the slurry was added 0.5 part of tributyl phosphate as anti-foaming agent, 1.0 part of potassium oleate as release agent, 6 parts by weight of casein as an aqueous casein solution having a concentration of 15%, dissolved with ammonia, and 16 parts by weight of styrene-butadiene copolymer in the form of a latex (SN-307 made by Sumitomo Naugatuch Co., Ltd., Japan), and also water, so as to obtain a coating preparation having a solids content of 45%.

This coating composition was used to perform a rewet casting method by means of a device shown in FIG. 1. The coating was applied by an air knife coater 2 onto base paper 1 having a basis weight of 80 g/m$^2$, so as to apply 28 g/m$^2$ of coating, dry weight, and the paper 1 was dried by a drying machine 3 to a moisture content of 6%. Then the paper was passed through a press nip 6 formed of a rubber roll 4 of 750 mm in diameter and a chromium-plated casting drum 5, 1500 mm in diameter, when the surface of the coating layer was remoistened by rewetting liquid (concentration of 0.5%) containing polyethylene emulsion supplied from a nozzle 7, the paper was then pressed against the drum 5 under the pressure of 200 kg/cm, and dried by means of casting drum 5 heated to a surface temperature of 105° C. The cast coated paper was then released from the casting drum at take-off roll 8. The operating speed and the characteristics of the cast coated papers in the examples and in the comparison examples, are listed in Table 1.

EXAMPLE 11

A cast coated paper was obtained in the same manner as in Example 1 except that the pigment mixture consisted of 10 parts kaolin and 90 parts cubic calcium carbonate having a mean particle size of 0.15 micron, and the surface temperature of the casting drum was 135° C. and the pressure at the press roll was 250 kg/cm$^2$. The operating speed of the casting process was 85 m/min. The cast coated paper obtained had a gloss of 88% and a whiteness of 87%. Ink set and dry pick were evaluated in the same way as in Example 1, and there was no problem.

EXAMPLE 12

70 parts of kaolin (Ultra-White 90), 20 parts of cubic calcium carbonate having a mean particle size of 0.15 micron, 10 parts of aluminum hydroxide, 0.5 part of sodium polyacrylate as a dispersant, and 0.5 part of sodium pyrophosphate as a dispersant were dispersed in water by means of a Cowles dissolver so as to prepare a pigment slurry having a solids content of 70%. 0.5 part of tributyl phosphate as anti-foaming agent, 1.0 part of ammonium oleate as a release agent, 13 parts by weight of casein added as an aqueous ammonia dispersion, and 11 parts dry weight of styrene-butadiene copolymer as a latex (SN-307 made by Sumitomo Naugatuch) as adhesive were mixed in said slurry, and water was further added to the mixture so as to obtain a coating composition having a solids content of 55%.

Figure 2:
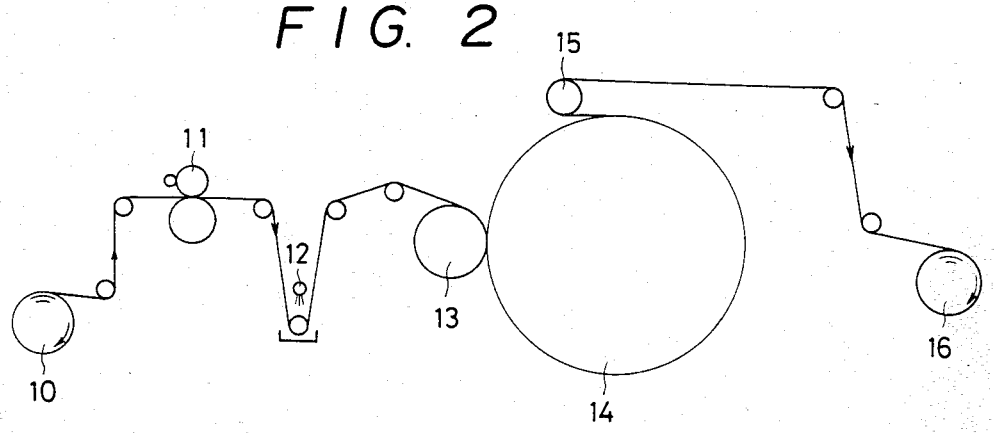
FIG. 2 is a schematic view of gel-casting process used to carry out example 12 according to the invention.

This composition was applied to the paper by means of a gel-casting method as shown in FIG. 2. The coating was applied by a roll coater 11 onto the base paper 10 having a basis weight of 90 g/m$^2$ so that the dry weight of coating was 25 g/m$^2$, the paper was then contacted with aqueous calcium formate 12 having a concentration of 0.5% to gel the coating layer. The paper was then pressed under the pressure of 100 kg/cm between a press roll 13, 800 mm in diameter, and a casting drum 14, 3000 mm in diameter, and dried against the drum at a surface temperature of 98° C.; the cast coated paper 16 was then released from the casting drum at take-off roll 15. The cast coating speed in this case was 60 meters per minute. The cast coated paper obtained exhibited a gloss of 90% and a whiteness of 82%. Ink set and dry pick were evaluated in the same manner as in Example 1, and there were no problems.

COMPARISON EXAMPLE 10

A cast coated paper was produced in the same manner as in Example 12 with the exception of using pigment mixture consisting of 90 parts of kaolin and 10 parts of aluminum hydroxide. The maximum casting speed operable in this case was 40 m/min. The paper exhibited a gloss of 90%, and a whiteness of 80%. Ink set and dry pick were evaluated in the same methods as in Example 1, and no problem was found.

EXAMPLE 13

70 parts of kaolin (Ultra-White 90), 30 parts of cubic calcium carbonate having a mean particle size of 0.15 mircron, 0.5 part of sodium polyacrylate as dispersant, and 0.5 part of sodium pyrophosphate were dispersed in water by means of a Cowles dissolver so as to prepare a pigment slurry having a solids content of 70%. 0.5 part of tributyl phosphate as anti-foaming agent, 1.0 part of ammonium stearate as a release agent, 12 parts of casein dry weight, added as an aqueous ammonia dispersion, and 12 parts of butadiene-methylmethacrylate copolymer dry weight, as a latex, were mixed in said slurry, and water was added to the mixture to prepare coating composition having a solids content of 53%.

This coating composition was cast finished on a paper web by a conventional wet casting method. More particularly, the coating composition was applied to a base paper having a basis weight of 120 g/m$^2$ so as to apply a dry coating weight of 28 g/m$^2$, the paper was immediately pressed against a polished chromium-plated drum, 2500 mm in diameter, heated to a surface temperature of 80° C., to produce a cast coated paper. The casting speed in this case was 42 m/min.

The cast coated paper exhibited a gloss of 82% and a whiteness of 82%. Ink set and dry pick were evaluated in the same methods as in Example 1, and no problem was evident.

COMPARISON EXAMPLE 11

Paper was cast finished in the same manner as in Example 13 except that amorphous calcium carbonate having a mean particle size of 4 microns was used as pigment instead of the cubic calcium carbonate. The casting speed operable in this case was 43 m/min., the whiteness was 82%. Ink set and dry pick were evaluated, and no problem was evident. However, the gloss of the paper was as low as 74%.

TABLE 1

| | Mixture of pigment | | | | | Effects | | | | |
|---|---|---|---|---|---|---|---|---|---|---|
| | Kaolin | Cubic calcium carbonate | | | Spindle $CaCO_3$ | Oper. speed | Gloss | Whiteness | | |
| | (UW-90) | 0.15 μm | 0.5 μm | 0.08 μm | 2.0 μm | m/min | % | % | Ink set | Dry pick |
| Example 1 | 90 | 10 | | | | 61 | 92 | 79 | | |
| 2 | 80 | 20 | | | | 65 | 92 | 80 | | |

TABLE 1-continued

| | Mixture of pigment | | | | | Effects | | | | |
|---|---|---|---|---|---|---|---|---|---|---|
| | Kaolin | Cubic calcium carbonate | | | Spindle $CaCO_3$ | Oper. speed | Gloss | Whiteness | | |
| | (UW-90) | 0.15 μm | 0.5 μm | 0.08 μm | 2.0 μm | m/min | % | % | Ink set | Dry pick |
| 3 | 70 | 30 | | | | 68 | 92 | 82 | | |
| 4 | 60 | 40 | | | | 70 | 91 | 83 | | |
| 5 | 45 | 55 | | | | 75 | 90 | 84 | | |
| 6 | 30 | 70 | | | | 80 | 89 | 85 | | |
| 7 | 90 | | 10 | | | 60 | 92 | 78 | | |
| 8 | 80 | | 20 | | | 65 | 91 | 80 | | |
| 9 | 70 | | 30 | | | 68 | 91 | 81 | | |
| 10 | 60 | | 40 | | | 70 | 91 | 83 | | |
| C. Example 1 | 90 | | | 10 | | 60 | 91 | 79 | | Δ |
| 2 | 80 | | | 20 | | 64 | 91 | 80 | | X |
| 3 | 70 | | | 30 | | 68 | 90 | 82 | | X |
| 4 | 60 | | | 40 | | 70 | 90 | 83 | | X |
| 5 | 90 | | | | 10 | 60 | 83 | 79 | | |
| 6 | 80 | | | | 20 | 65 | 81 | 80 | | |
| 7 | 70 | | | | 30 | 68 | 79 | 82 | | |
| 8 | 60 | | | | 40 | 70 | 78 | 83 | | |
| 9 | 97 | 3 | | | | 45 | 92 | 77 | X | |

NOTES
Operating speed indicates maximum operable speed.
Gloss was measured in accordance with JIS P 8142
Whiteness was measured in accordance with JIS P 8123.
Ink set was evaluated in terms of the degree of ink offset when the paper was printed at a speed of 6000 sheets/hour by means of a two color offset printing machine. (Roland Rekord Type: REK IIIb, made in Germany)
: Excellent without offset
: No problem in practical use with slight offset
X: Impossible to use with many offsets
Dry pick was evaluated by means of an RI printing tester made by Akira Industry Co., Japan
: Excellent without pick
Δ: Slight picks
X: Many picks

What is claimed is:

1. A method of increasing the rate of production of cast coated paper which comprises applying to a web of base paper an aqueous coating composition, the pigment component of which contains 30% to 80% by weight of cubic calcium carbonate having a mean particle size of 0.1 to 1.0 microns, and finishing the surface of the coating layer by bringing it into contact with a finishing surface of a cast coating drum at a temperature above 90° C., said cast coated paper having a gloss of above 88%.

2. The method of claim 1 wherein the pigment component of said aqueous coating composition contains 40% to 70% by weight of said cubic calcium carbonate.

3. The method of claim 1 wherein the temperature of said heated finishing surface is 100° C. to 140° C.

4. The method of claim 1 in which the cast coated paper is produced by a re-wet casting process or by a gel-casting process.

5. The product obtained by the process of claim 1.

6. The product obtained by the process of claim 2.

7. The product obtained by the process of claim 3.

8. The product obtained by the process of claim 4.

* * * * *